US008375607B2

(12) United States Patent
Menze

(10) Patent No.: US 8,375,607 B2
(45) Date of Patent: Feb. 19, 2013

(54) SYSTEM FOR CONTROLLING ACTUATION OF A SNOW PLOW BLADE USING THE TURN SIGNAL/HIGH BEAM CONTROL STALK

(75) Inventor: William F. Menze, Escanaba, MI (US)

(73) Assignee: Sno-Way International, Inc., Hartford, WI (US)

( * ) Notice: Subject to any disclaimer, the term of this patent is extended or adjusted under 35 U.S.C. 154(b) by 590 days.

(21) Appl. No.: 12/683,481

(22) Filed: Jan. 7, 2010

(65) Prior Publication Data

US 2010/0175282 A1 Jul. 15, 2010

Related U.S. Application Data

(60) Provisional application No. 61/143,509, filed on Jan. 9, 2009.

(51) Int. Cl.
*E01H 5/04* (2006.01)

(52) U.S. Cl. ..... 37/234

(58) Field of Classification Search ..... 37/232–234, 37/466, 468, 348, 235, 236; 200/5 R, 5 A, 200/61.54, 61.55, 61.57, 61.27, 61.28
See application file for complete search history.

(56) References Cited

U.S. PATENT DOCUMENTS

| | | | | |
|---|---|---|---|---|
| 3,221,119 | A | 11/1965 | Weathers et al. | |
| 3,671,691 | A * | 6/1972 | Suzuki et al. | 200/61.54 |
| 4,831,752 | A * | 5/1989 | Clevenger | 37/234 |
| 6,163,985 | A * | 12/2000 | Chinnery et al. | 37/234 |
| RE38,665 | E | 12/2004 | Struck et al. | |
| 6,852,934 | B1 * | 2/2005 | Lashua | 200/5 R |

* cited by examiner

*Primary Examiner* — Robert Pezzuto
(74) *Attorney, Agent, or Firm* — Reinhart Boerner Van Deuren s.c.

(57) ABSTRACT

A system for controlling the operation of a snow plow blade mounted on a vehicle that uses the turn signal/high beam control stalk mounted on the steering wheel of the vehicle to control a actuation of the snow plow blade mounted on the vehicle. The control system operates in two alternately selectable modes, one of which allows the turn signal/high beam control stalk to be used to operate the turn signals and high beams of the vehicle, and the other of which allows the turn signal/high beam control stalk to be used to raise, lower, and pivot the snow plow blade. The control system may be switched between the two modes by initiating one of two respective sequences of actuation of one or more electrical switches in the vehicle.

20 Claims, 4 Drawing Sheets

SYSTEM FOR CONTROLLING ACTUATION OF A SNOW PLOW BLADE USING THE TURN SIGNAL/HIGH BEAM CONTROL STALK

CROSS-REFERENCE TO RELATED APPLICATION

This patent application claims priority of U.S. Provisional Patent Application No. 61/143,509, which is entitled "System for Controlling Actuation of a Snow Plow Blade Using the Turn Signal/High Beam Control Stalk," and which was filed on Jan. 9, 2009, which patent application is hereby incorporated herein by reference in its entirety.

BACKGROUND OF THE INVENTION

Field of the Invention

The present invention relates generally to systems for controlling the operation of a snow plow blade mounted on a vehicle, and more particularly to such a system using the turn signal/high beam control stalk mounted on the steering wheel of the vehicle to control a actuation of the snow plow blade mounted on the vehicle.

Snow plows have been available as an accessory for light and medium duty trucks for some time. Most snow plows are removably installed onto the front end of a truck, with the operation of most truck-installed snow plow being controlled by a self-contained hydraulic system that is capably of at least raising and lowering the snow plow blade and orienting it in a desired orientation to control the displacement of snow by the snow plow blade. Hydraulically-controlled snow plows are operated by electric control systems that operate relays controlling the flow of hydraulic fluid in the snow plow hydraulic system to operate the snow plow blade.

This electrical actuation of the snow plow hydraulic system of the snow plow to manipulate the snow plow blade is controlled with a remote control typically including a number of switches that is located in the cab of the truck. Most such remote controls are electrically connected with the hydraulic system of the snow plow by running wires from the remote control in the truck cab to the relays on the hydraulic system of the snow plow. The wires are typically run through the dashboard, the firewall, the engine compartment, and the front grill of the truck. Between the truck and the snow plow, the wires have engaging plugs to allow the snow plow to be removed from the truck. Such wired remote controls are typically left in the truck even when the snow plow has been removed from the truck, the remote control can be in the way of the operator or interfere with access to other vehicle controls while serving no useful purpose.

A wireless remote controls for snow plows is taught in U.S. Pat. No. RE 38,665, to Struck et al., which patent is assigned to the assignee of the present patent application, and which patent is hereby incorporated herein in its entirety. The wireless remote control system of the Struck et al. patent controls the snow plow hydraulic system to cause it to operate the snow plow blade, with a receiver being permanently mounted on the snow plow and a wireless transmitter being useable either in the cab of the truck or outside the truck cab in proximity to receiver on the snow plow. The remote control system of the Struck et al. patent is capable of operating the snow plow to raise, lower, and pivot the snow plow blade.

Both the wired remote controls and the wireless remote controls used to operate the snow plows supplement the controls which are integral to the vehicle. As such, unless they are specially mounted, they are not ergonomically located near the steering wheel of the vehicle, and they thus require the operator of the vehicle to remove his or her hands from the vicinity of the steering wheel in order to operate them.

SUMMARY OF THE INVENTION

The disadvantages and limitations of the background art discussed above are overcome by the present invention. With this invention, the turn signal/high beam control stalk of a vehicle is used to control the actuation of a snow plow mounted on the vehicle. The snow plow blade actuation system of the present invention includes interface connectors between the wires leading to the vehicle's turn signal/high beam control stalk, and may also tap into other vehicle electrical controls, including (but not limited to) the ignition switch, the headlight and marker light switches, the 4-way flasher switch, and the horn. The snow plow blade actuation system of the present invention is connected to actuate the snow plow blade, which is typically operated by a hydraulic system and solenoid-controlled hydraulic valves.

The snow plow blade actuation system of the present invention uses movement of the vehicle's turn signal/high beam control stalk to control movement of the plow. The use of the turn signal/high beam control stalk may be changed from its normal mode in which it operates the turn signals and the headlights of the vehicle to a plow control mode by the operation of the vehicles electrical switches (including but not limited to the ignition switch, the headlight and marker light switches, the 4-way flasher switch, and the horn) in a sequential manner that is unlikely to ever occur inadvertently. For example, the plow mode activation may consist of: 1. turning on the ignition switch; 2. turning on the marker lights (but not the headlights); 3. turning on the 4-way flashers; 4. turning off the 4-way flashers; and 5. turning on the headlights. Alternately, the plow mode activation may consist of the use of a separate switch to turn on or turn off the snow plow blade actuation system of the present invention.

In the plow mode, the plow blade may be caused to move to the left and the right by turning the turn signal/high beam control stalk to the left and to the right, respectively. The plow blade may be caused to be raised by pulling the turn signal/high beam control stalk toward the driver and simultaneously turning the turn signal/high beam control stalk to the right. The plow blade may be caused to be lowered by pulling the turn signal/high beam control stalk toward the driver and simultaneously turning the turn signal/high beam control stalk to the left.

In snow plows with the capability of applying and maintaining a downwardly-oriented pressure to the snow plow blade (DOWN PRESSURE is a trademark owned by the assignee of the present patent application), pulling the turn signal/high beam control stalk toward the driver and simultaneously turning the turn signal/high beam control stalk to the left a second consecutive time (optionally within a predetermined amount of time) or maintaining it in this position for longer than a predetermined period of time will cause the downwardly-oriented pressure to be applied to the snow plow blade. Alternately, the operation of the downwardly-oriented pressure to the snow plow blade may be controlled by the use of a separate switch to turn on or turn off the downwardly-oriented pressure.

Also alternately, the plow mode may instead be operated to cause the plow blade to be raised by turning the turn signal/high beam control stalk to the right, and to cause the plow blade to be lowered by turning the turn signal/high beam control stalk to the left. In this alternate implementation, the plow blade can be moved to the left by pulling the turn signal/high beam control stalk toward the driver and simultaneously turning the turn signal/high beam control stalk to the left, and the plow blade can be moved to the right by pulling the turn signal/high beam control stalk toward the driver and simultaneously turning the turn signal/high beam control stalk to the right. This is not the currently preferred mode, however.

To exit from the plow mode back in which the turn signal/high beam control stalk is used to control movement of the snow plow into normal mode in which the turn signal/high beam control stalk is used to control the turn signals and the headlights of the vehicle, a different operation of the vehicles electrical switches may be utilized. For example, the activation sequence causing a return from plow mode to normal mode may be as simple as turning off the marker lights or honking the horn. Alternately, the plow mode may instead be turned off by the use of the separate switch referenced above.

DESCRIPTION OF THE DRAWINGS

These and other advantages of the present invention are best understood with reference to the drawings, in which.

DETAILED DESCRIPTION OF THE EXEMPLARY EMBODIMENTS

Figure 1:
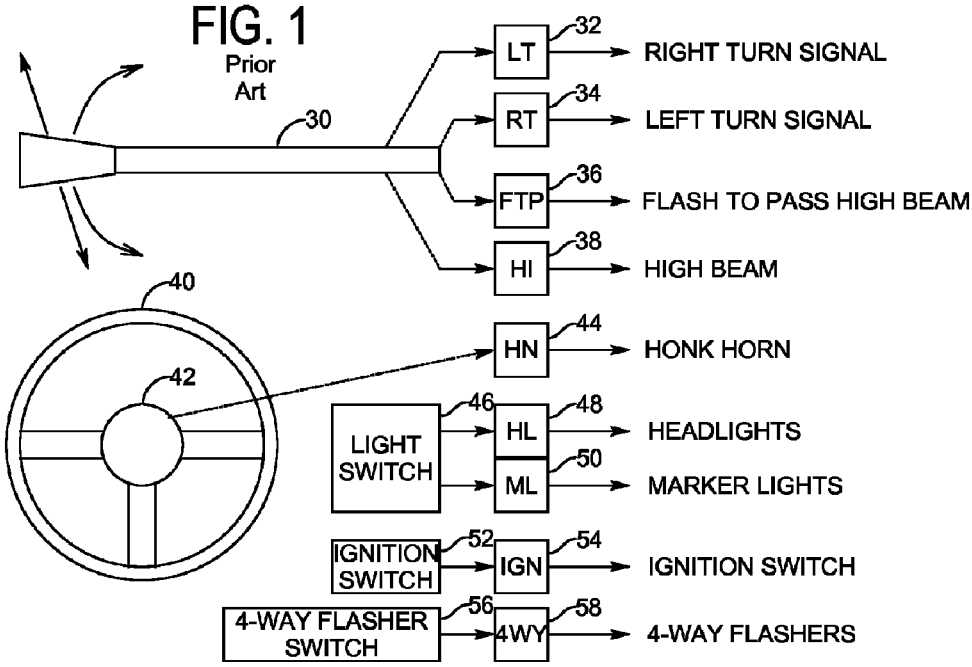
FIG. 1 Prior Art
FIG. 1 is a schematic depiction of the turn signal/high beam control stalk, the steering wheel, and the light and ignition switches of a vehicle.

Prior to discussing the exemplary embodiment of the present invention, it is useful to briefly discuss the vehicle controls that will be used to control the operation of an otherwise conventional snow plow that is mounted on the vehicle. Referring to FIG. 1, a turn signal/high beam control stalk 30 is shown that is typically used to operate the turn signals and to control the high beam headlights of the vehicle. Typically, the turn signal/high beam control stalk 30 has four outputs: a left turn signal output 32 that is used to cause the left turn signal of the vehicle to flash, a right turn signal output 34 that is used to cause the right turn signal of the vehicle to flash, a flash to pass high beam signal output 36 that is used to cause to cause the high beams of the vehicle to be illuminated, and a high beam signal output 38 that is also used to cause to cause the high beams of the vehicle to be illuminated.

The turn signal/high beam control stalk 30 may be urged downwardly to actuate the left turn signal output 32 and upwardly to actuate the right turn signal output 34. By pulling the turn signal /high beam control stalk 30 rearwardly toward the driver, the flash to pass high beam signal output 36 will be actuated until the turn signal/high beam control stalk 30 is released, at which time it will return to a central position. By pushing the turn signal/high beam control stalk 30 forward away from the driver, the high beam signal output 38 will be actuated until the turn signal/high beam control stalk 30 is pulled rearwardly to its central position.

A steering wheel 40 has a horn button 42 that, while pressed, will actuate a honk horn signal output 44. A light switch 46 may be actuated to produce either a headlight signal output 48 and a marker light signal output 50, or only the marker light actuation signal 50. An ignition switch 52 may be actuated to produce an ignition switch signal output 54. A 4-way flasher switch 56 may be actuated to produce a 4-way flasher signal output 58. All of these controls and output signals are standard on many different vehicles from a wide variety of manufacturers.

Figure 2:
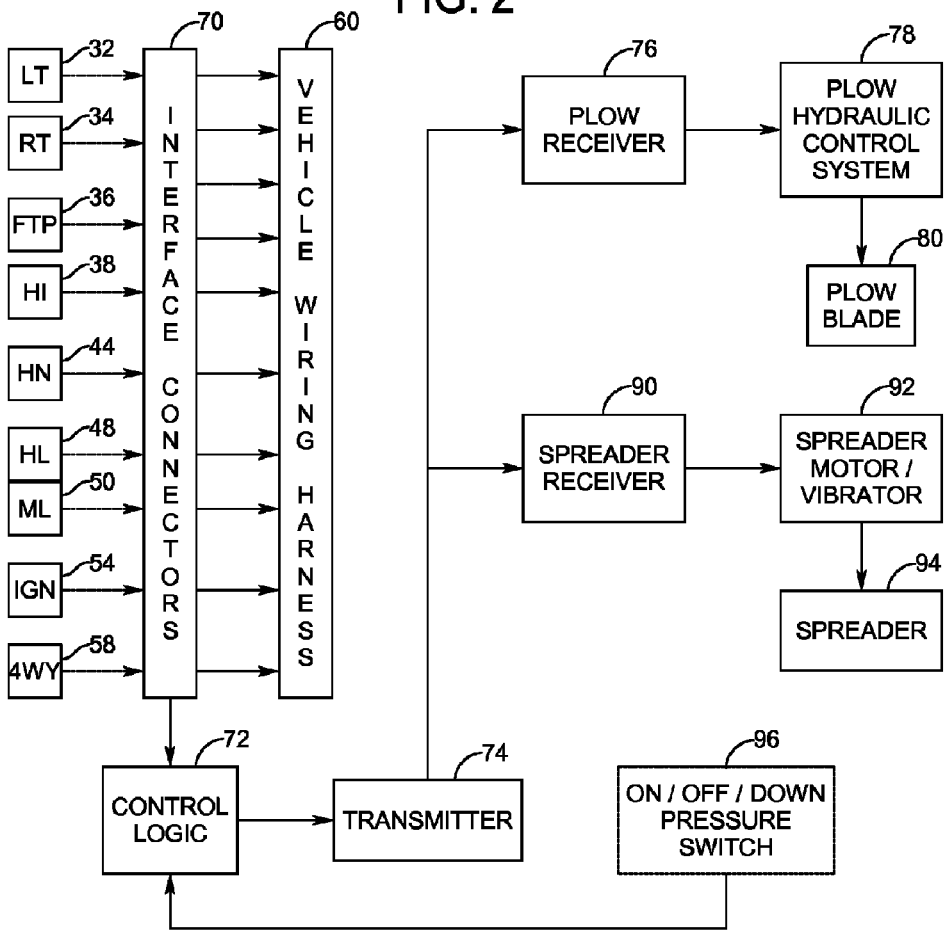
FIG. 2 is a functional schematic diagram of the snow plow blade actuation system of the present invention as it interfaces between the controls shown in FIG. 1 and, optionally, the hydraulic control system of a snow plow and the motor of a spreader.

An exemplary embodiment of the snow plow blade actuation system of the present invention is illustrated in FIG. 2. Prior to the installation of the snow plow blade actuation system of the present invention, the various signal outputs (the left turn signal output 32, the right turn signal output 34, the flash to pass high beam signal output 36, the high beam signal output 38, the honk horn signal output 44, the headlight signal output 48, the marker light signal output 50, the ignition switch signal output 54, and the 4-way flasher signal output 58) may be provided to a vehicle wiring harness 60 that is part of the vehicle. The snow plow blade actuation system of the present invention inserts interface connectors 70 between these signal outputs and the vehicle wiring harness 60. These interface connectors 70 provide both the signal outputs as well as connections to the vehicle wiring harness 60 to a control logic element 72.

The control logic element 72 operates in two alternate modes—a first or vehicle mode, in which it connects the various signal outputs from the turn signal/high beam control stalk 30 (the left turn signal output 32, the right turn signal output 34, the flash to pass high beam signal output 36, and the high beam signal output 38) to the vehicle wiring harness 60. In this operating mode, the various signal outputs operate the vehicle in the manner they were originally intended to (the left turn signal output 32 operates the left turn signal of the vehicle, the right turn signal output 34 operates the right turn signal of the vehicle, the flash to pass high beam signal output 36 operates the high beams of the vehicle so long as the turn signal/high beam control stalk 30 is pulled toward the driver, and the high beam signal output 38 when actuated operates the high beams of the vehicle).

The control logic element 72 has a second or plow mode, in which the various signal outputs from the turn signal/high beam control stalk 30 do not operate the vehicle in the manner there were originally intended to, but instead are used to operate the snow plow blade. In this operating mode, the turn signal/high beam control stalk 30 is used to raise, lower, and tilt the blade of the snow plow on the vehicle, and does not operate the turn signals and high beams as it did in the first or vehicle mode.

In this second or plow mode, the control logic element 72 will generate signals to control the blade of the snow plow. These signals are sent by the control logic element 72 to a transmitter 74 (typically located in the vehicle), which transmits them to a plow receiver 76 (typically located on the plow). (Instead of the transmitter 74 and the plow receiver 76 a series of relays connected by wiring could be used.) The plow receiver 76 then sends control signals to a plow hydraulic control system 78, which raises, lowers, and pivots a plow blade 80.

In a first embodiment of the second or plow mode, the plow blade 80 may be caused to move to the left and the right by turning the turn signal/high beam control stalk 30 to the left and to the right, respectively. Thus, instead of operating the left and right turn signals, this movement of the turn signal /high beam control stalk 30 causes the plow blade 80 to be moved to the left and the right, respectively. In this embodiment, the plow blade 80 may be caused to be lowered, for example, by pulling the turn signal/high beam control stalk 30 toward the driver and simultaneously turning the turn signal/high beam control stalk 30 to the left. The plow blade 80 may be caused to be raised by pulling the turn signal/high beam control stalk 30 toward the driver and simultaneously turning the turn signal/high beam control stalk 30 to the right. (Those skilled in the art will appreciate that these actuations may be reversed if it is so desired.)

If the snow plow used has the capability of applying and maintaining a downwardly-oriented pressure to the plow blade 80, pulling the turn signal/high beam control stalk 30 toward the driver and simultaneously turning the turn signal/high beam control stalk 30 to the left a second consecutive time (particularly within a predetermined amount of time) may, for example, be used to cause the downwardly-oriented pressure to be applied to the plow blade 80.

In an alternate embodiment of the second or plow mode, the snow plow blade actuation system may be configured so that the plow blade 80 may be caused to be raised by turning the turn signal/high beam control stalk 30 to the right, and the plow blade 80 may be caused to be lowered by turning the turn signal/high beam control stalk to the left. In this alternate implementation, the plow blade 80 may be caused to be moved to the left by pulling the turn signal/high beam control stalk 30 toward the driver and simultaneously turning the turn signal/high beam control stalk 30 to the left, and the plow blade may be caused to be moved to the right by pulling the turn signal/high beam control stalk 30 toward the driver and simultaneously turning the turn signal/high beam control stalk 30 to the right. Other similar alternate embodiments are also possible, as will be appreciated by those skilled in the art.

In an additional embellishment or alternate embodiment, the actuation system of the present invention may be used to control a spreader mounted on the back of the vehicle. Spreader controls typically include at least an on/off control, and may optionally include a spreader speed control and/or a spreader vibrate control as well. A spreader may be controlled by the turn signal/high beam control stalk 30 by either using it in a different manner, or by adding a third mode to the control system. In the system shown in FIG. 2, the transmitter 74 would also transmit to a spreader receiver 90 (typically located on or near the spreader). The spreader receiver 90 would then send control signals to a spreader motor/vibrator 92, which would control the operation of a spreader 94.

As an example of using the control system to operate both the plow blade 80 and the spreader 94 in the second or plow mode, by pushing the turn signal /high beam control stalk 30 forward (to the position that would in the first or vehicle mode turn the high beams of the vehicle on) and then turning the turn signal/high beam control stalk 30 to the left or the right, the spreader can be turned on and off as well as having its speed varied. For example, by pushing the turn signal/high beam control stalk 30 forward and turning the turn signal/high beam control stalk to the left and holding it there for a predetermined time, the spreader receiver 90 can initially be slowed (if it has a variable speed feature) and then be turned off. By pushing the turn signal/high beam control stalk 30 forward and turning the turn signal/high beam control stalk 30 to the right and holding it there for a predetermined time, the spreader receiver 90 can be turned on and be sped up (if it has a variable speed feature). A vibrator may be controlled, for example, by pulling the turn signal/high beam control stalk 30 backward and holding it there for a predetermined time to turn the vibrator on or off.

Optionally, an on/off/down pressure switch 96 may be operatively connected to the control logic element 72 to control the operation of the snow plow blade actuation system of the present invention. The on/off/down pressure switch 96 may be used to turn the snow plow blade actuation system on and off instead of using a particular sequence of actuations of the controls as will be discussed below. If the snow plow used with the snow plow blade actuation system of the present invention has the capability of applying and maintaining a downwardly-oriented pressure to the plow blade 80, the on/off/down pressure switch 96 may optionally be used to turn that feature on and off. If this feature is turned on, by merely lowering the plow blade 80 fully it will be maintained with the downwardly-oriented pressure applied thereto.

Figure 3:
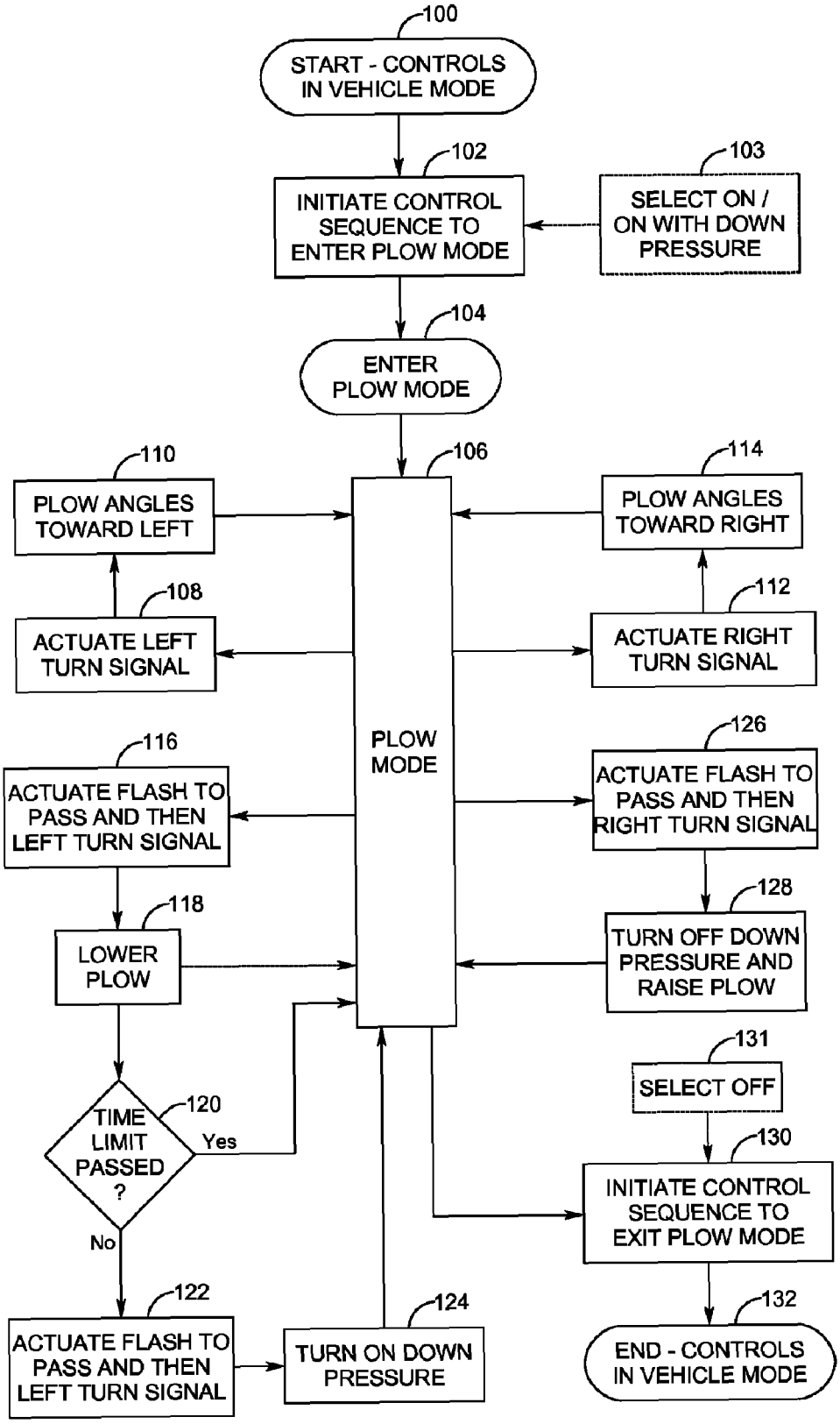
FIG. 3 is a flowchart showing at a high level a mode of operation of the snow plow blade actuation system of the present invention illustrated in FIG. 2.

Referring next to FIG. 3, another exemplary method of controlling the operation of a snow plow blade mounted on a vehicle in accordance with the first embodiment discussed above in conjunction with FIG. 2 is illustrated. In an initiate process step 100, the snow plow blade actuation system is in the first or vehicle mode. In a plow mode initiation step 102, a control sequence is entered, preferably by using switches located in the vehicle. For example, the plow mode initiation sequence may consist of: 1. turning on the ignition switch; 2. turning on the marker lights (but not the headlights); 3. turning on the 4-way flashers; 4. turning off the 4-way flashers; and 5. turning on the headlights.

Alternately, if an on/off/down pressure switch 96 (shown in FIG. 2) is provided, it may be used in conjunction with a select on/on with down pressure step 103 to turn the snow plow blade actuation system on and, optionally, to also turn on the downward pressure feature if it is present. In either event, by doing so, the snow plow blade actuation system is placed into the second or plow mode, as indicated by an enter plow mode process step 104, following which the snow plow blade actuation system is in the second or plow mode 106.

From the plow mode 106, the turn signal /high beam control stalk 30 may be turned to the left (to the position that would in the first or vehicle mode turn the left turn signal of the vehicle on) in an actuate left turn signal step 108. While the turn signal/high beam control stalk 30 is so turned to the left, the plow blade 80 will be operated to turn it to the left in a plow angles toward left step 110, after which the control system will return to the plow mode 106. From the plow mode 106, the turn signal/high beam control stalk 30 may be turned to the right (to the position that would in the first or vehicle mode turn the right turn signal of the vehicle on) in an actuate right turn signal step 112. While the turn signal/high beam control stalk 30 is so turned to the right, the plow blade 80 will be operated to turn it to the right in a plow angles toward right step 114, after which the control system will return to the plow mode 106.

From the plow mode, the turn signal/high beam control stalk 30 may be pulled toward the driver (to the position that would in the first or vehicle mode turn the high beams on in flash to pass mode) and simultaneously turned to the left (to the position that would in the first or vehicle mode turn the left turn signal of the vehicle on) in an actuate flash to pass and left turn signal step 116. While the turn signal/high beam control stalk 30 is so pulled toward the driver and turned to the left, the plow blade 80 will be operated to lower it in a lower plow step 118. If the snow plow on the vehicle does not have the capability of applying and maintaining a downwardly-oriented pressure to the plow blade 80, or if the turn signal/high beam control stalk 30 is released before the plow blade is fully lowered (since the plow blade can be jogged downwardly), the control system will return to the plow mode 106 as shown by the dotted line from the lower plow step 118 to the plow mode 106.

If, on the other hand, the snow plow on the vehicle has the capability of applying and maintaining a downwardly-oriented pressure to the plow blade 80, a time measurement determination step 120 is used. If the turn signal/high beam control stalk is pulled toward the driver and simultaneously turned to the left a second time before the predetermined amount of time measured by the time measurement determination step 120 expires in a second actuate flash to pass and left turn signal step 122, the downwardly-oriented pressure will be applied to the plow blade 80 (assuming that it is fully lowered) in a turn on downward pressure step 124, following which the control system will return to the plow mode 106. If the turn signal/high beam control stalk is not pulled toward the driver and simultaneously turned to the left a second time before the predetermined amount of time measured by the time measurement determination step 120 expires, the control system will instead return from the time measurement determination step 120 to the plow mode 106.

From the plow mode, the turn signal/high beam control stalk 30 may be pulled toward the driver (to the position that would in the first or vehicle mode turn the high beams on in flash to pass mode) and simultaneously turned to the right (to the position that would in the first or vehicle mode turn the right turn signal of the vehicle on) in an actuate flash to pass and right turn signal step 126. While the turn signal/high beam control stalk 30 is so pulled toward the driver and turned to the right, the plow blade 80 will be operated to turn off the downwardly-oriented pressure and raise the plow blade 80 in a turn off downward pressure and raise plow step 128, after which the control system will return to the plow mode 106. It will be appreciated that a short actuation of the actuate flash to pass and right turn signal step 126 may be used to jog the plow blade upwardly.

It will be appreciated by those skilled in the art that other control sequences may be used to operate the plow blade 80 (and indeed one such alternate set of control sequences is provided above in the Summary of the Invention).

In a vehicle mode initiation step 130, a second control sequence may be entered, again preferably by using switches located in the vehicle. For example, the vehicle mode initiation sequence may consist of simply turning off the marker lights of pressing the horn button 42. By doing so, the snow plow blade actuation system is placed back into the first or vehicle mode, as indicated by an enter vehicle mode process step 132, following which the snow plow blade actuation system is in the first or vehicle mode. Alternately, if an on/off/down pressure switch 96 (shown in FIG. 2) is provided, it may instead be used to turn the snow plow blade actuation system of the present invention off.

Figure 4:
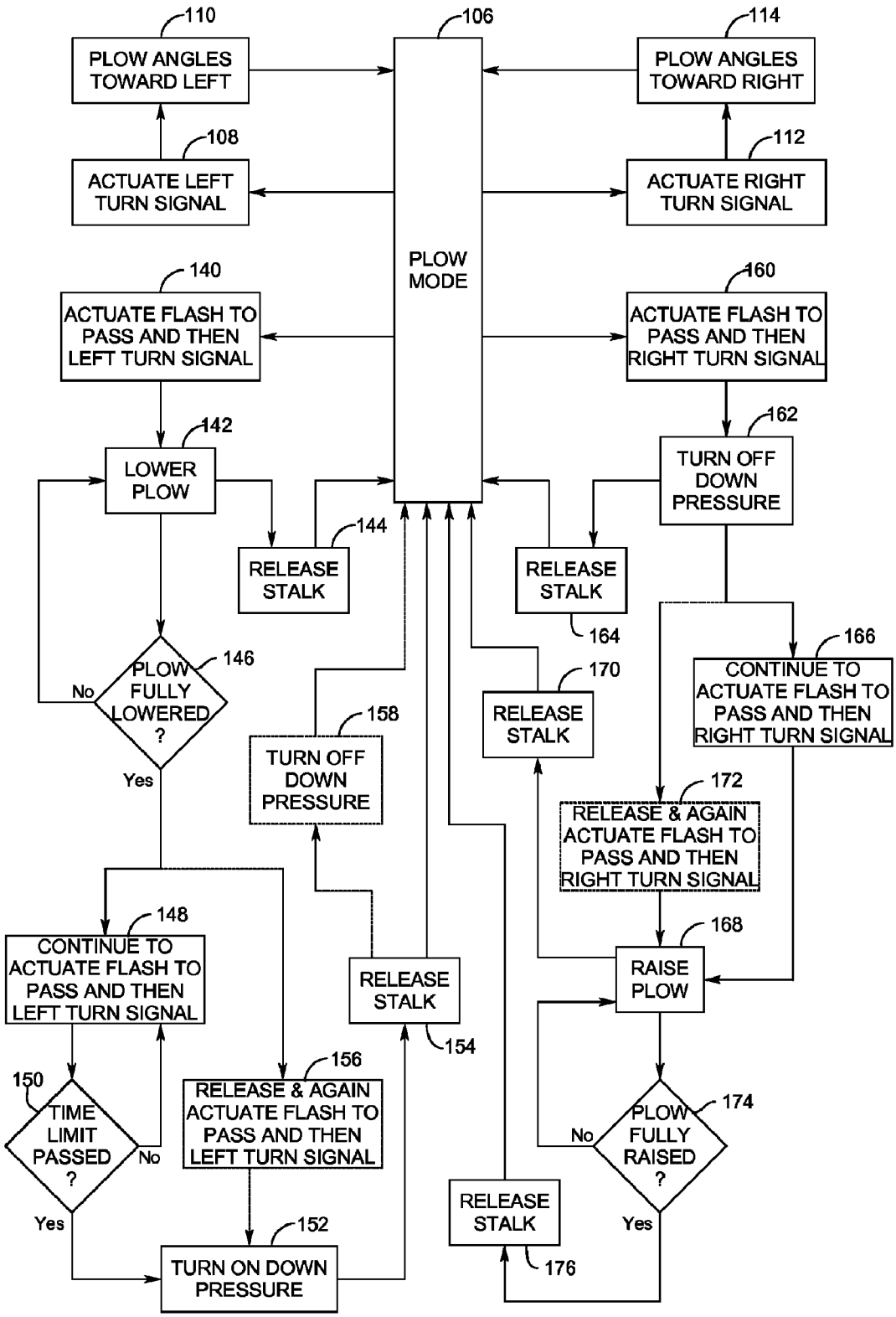
FIG. 4 is a flowchart showing at a high level an alternate mode of operation of the snow plow blade actuation system of the present invention illustrated in FIG. 2.

Referring next to FIG. 4, another alternate manner of controlling the raising and lowering of the plow blade as well as controlling a downward pressure system incorporated in the plow being operated is illustrated. It will be noted that the embodiment shown in FIG. 4 only concerns the operation of the second or plow mode 106, and not the manner of entering into and exiting from the second or plow mode 106. The manner of operating the plow blade to angle it left or right is the same as that discussed above in conjunction with FIG. 3, with the same reference numerals being used for the various steps, which will not be discussed further in conjunction with FIG. 4.

From the plow mode, the turn signal/high beam control stalk 30 may be pulled toward the driver (to the position that would in the first or vehicle mode turn the high beams on in flash to pass mode) and simultaneously turned to the left (to the position that would in the first or vehicle mode turn the left turn signal of the vehicle on) in an actuate flash to pass and left turn signal step 140. While the turn signal/high beam control stalk 30 is so pulled toward the driver and turned to the left, the plow blade 80 will be operated to lower it in a lower plow step 142. If the turn signal/high beam control stalk 30 is released before the plow blade is fully lowered (since the plow blade can be jogged downwardly) in a release stalk step 144, the control system will return to the plow mode 106 as shown by the dotted line from the lower plow step 142 to the plow mode 106. This allows the plow blade to be jogged downwardly.

A plow fully lowered determination step 146 is used to determine whether or not the plow blade is fully lowered. If, after the plow fully lowered determination step 146 has determined that the plow blade has been fully lowered, the turn signal/high beam control stalk continues to be pulled toward the driver and simultaneously turned to the left as shown in a continue to actuate flash to pass and left turn signal step 148 for a predetermined amount of time as measured by a time measurement determination step 150, the downwardly-oriented pressure will be applied to the plow blade 80 in a turn on downward pressure step 152, after which the turn signal/high beam control stalk is released in a release stalk step 154 and the control system will return to the plow mode 106.

In a first alternate manner of operation, instead of requiring that the turn signal/high beam control stalk continue to be held for a predetermined amount of time after the plow blade is fully lowered, it is instead required that the turn signal/high beam control stalk be released and then again be pulled toward the driver and simultaneously turned to the left as shown in a release and again actuate flash to pass and left turn signal step 156. If this occurs (optionally within a predetermined amount of time after the plow blade is fully lowered), the downwardly-oriented pressure will be applied to the plow blade 80 in the turn on downward pressure step 152, after which the turn signal/high beam control stalk is released in the release stalk step 154 and the control system will return to the plow mode 106.

In a second alternate manner of operation, when the turn signal/high beam control stalk is released in the release stalk step 154, the downwardly-oriented pressure applied to the plow blade 80 will be turned off in a turn off downward pressure step 158, following which the control system will return to the plow mode 106. In this alternate manner of operation, down pressure will only continue to be applied for so long as the turn signal/high beam control stalk is pulled toward the driver and simultaneously turned to the left.

From the plow mode, and assuming that the downwardly-oriented pressure is being applied to the plow blade 80, the turn signal/high beam control stalk 30 may be pulled toward the driver (to the position that would in the first or vehicle mode turn the high beams on in flash to pass mode) and simultaneously turned to the right (to the position that would in the first or vehicle mode turn the right turn signal of the vehicle on) in an actuate flash to pass and right turn signal step 160. By so doing even briefly, the downwardly-oriented pressure applied to the plow blade 80 will be turned off in a turn off downward pressure step 162. If the turn signal/high beam control stalk is only briefly so actuated and is then released in a release stalk step 164, the control system will then return to the plow mode 106.

If, on the other hand, the turn signal /high beam control stalk continues to be pulled toward the driver and simultaneously turned to the right as shown in a continue to actuate flash to pass and right turn signal step 166 (optionally for more than a minimum predetermined amount of time), the plow blade 80 will be operated to raise it in a raise plow step 168. It should be noted that if the downwardly-oriented pressure is already off, the process will move directly from the actuate flash to pass and right turn signal step 160 to the continue to actuate flash to pass and left turn signal step 166. Further, by pulling the turn signal/high beam control stalk toward the driver and simultaneously turning it to the right in the continue to actuate flash to pass and right turn signal step 166 for a brief time, the plow blade can be jogged upwardly in the raise plow step 168.

In an alternate manner of operation, instead of requiring that the turn signal/high beam control stalk continue to be held for a predetermined amount of time after the downwardly-oriented pressure is already off is turned off, it is instead required that the turn signal/high beam control stalk be released and then again be pulled toward the driver and simultaneously turned to the right as shown in a release and again actuate flash to pass and right turn signal step 172. If this occurs (optionally within a predetermined amount of time after the downwardly-oriented pressure is turned off), the plow blade 80 will be operated to raise it in the raise plow step 168. Again, upon releasing the turn signal/high beam control stalk in the release stalk step 170, the control system will return to the plow mode 106.

A plow fully raised determination step 174 is used to determine whether or not the plow blade is fully raised. If, after the plow fully raised determination step 174 has determined that the plow blade has not been fully raised, and the turn signal /high beam control stalk continues to be pulled toward the driver and simultaneously turned to the right in the continue to actuate flash to pass and right turn signal step 166, the plow blade will continue to be raised until it is determined in the plow fully raised determination step 174 that the plow blade is fully raised, after which the turn signal/high beam control stalk may be released in a release stalk step 176 and the control system will return to the plow mode 106.

Figure 5:
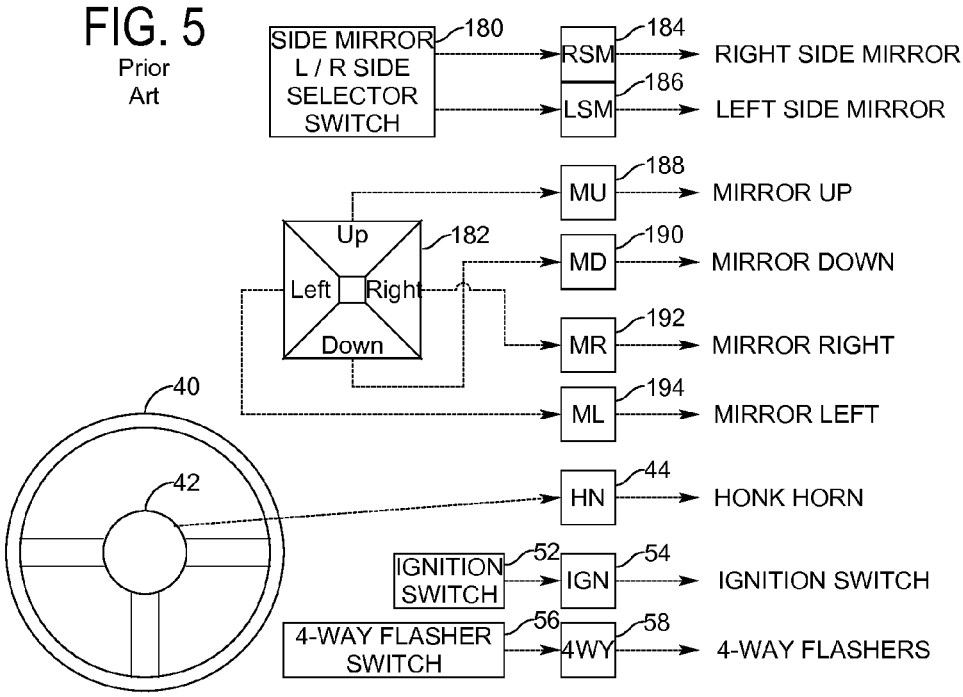
FIG. 5 Prior Art
FIG. 5 is a schematic depiction similar to that of FIG. 1, but showing the side mirror selector switch and the side mirror directional switch, the steering wheel, and the light and ignition switches of a vehicle.

An alternate embodiment to the embodiments of the snow plow blade actuation system of the present invention shown in and discussed with reference to FIGS. 1 through 4 is shown in and will be discussed with reference to FIGS. 5 and 6. FIG. 5 shows some of the vehicle controls shown in FIG. 1, but with the vehicle controls used to operate a power side mirror system shown instead of the turn signal/high beam control stalk 30 shown in FIG. 1. Referring now to FIG. 5, a side mirror selector switch 180 and a side mirror directional control switch 182 that are used together to operate the side mirrors of the vehicle are shown. The side mirror selector switch 180 has two outputs: a right side mirror output 184 that will cause the side mirror directional control switch 182 to operate the power mirror on the right side of the vehicle, and a left side mirror output 186 that will cause the side mirror directional control switch 182 to operate the power mirror on the left side of the vehicle.

The side mirror directional control switch 182 has four outputs: a mirror up output 188 that will cause the power mirror being operated by the side mirror directional control switch 182 to move upwardly; a mirror down output 190 that will cause the power mirror being operated by the side mirror directional control switch 182 to move downwardly; a mirror right output 192 that will cause the power mirror being operated by the side mirror directional control switch 182 to move to the right; and a mirror left output 194 that will cause the power mirror being operated by the side mirror directional control switch 182 to move to the left. The side mirror directional control switch 182 may have the "UP" surface thereof depressed to actuate the mirror up output 188, the "DOWN" surface thereof depressed to actuate the mirror down output 190, the "RIGHT" surface thereof depressed to actuate the mirror right output 192, and the "LEFT" surface thereof depressed to actuate the mirror left output 194.

Figure 6:
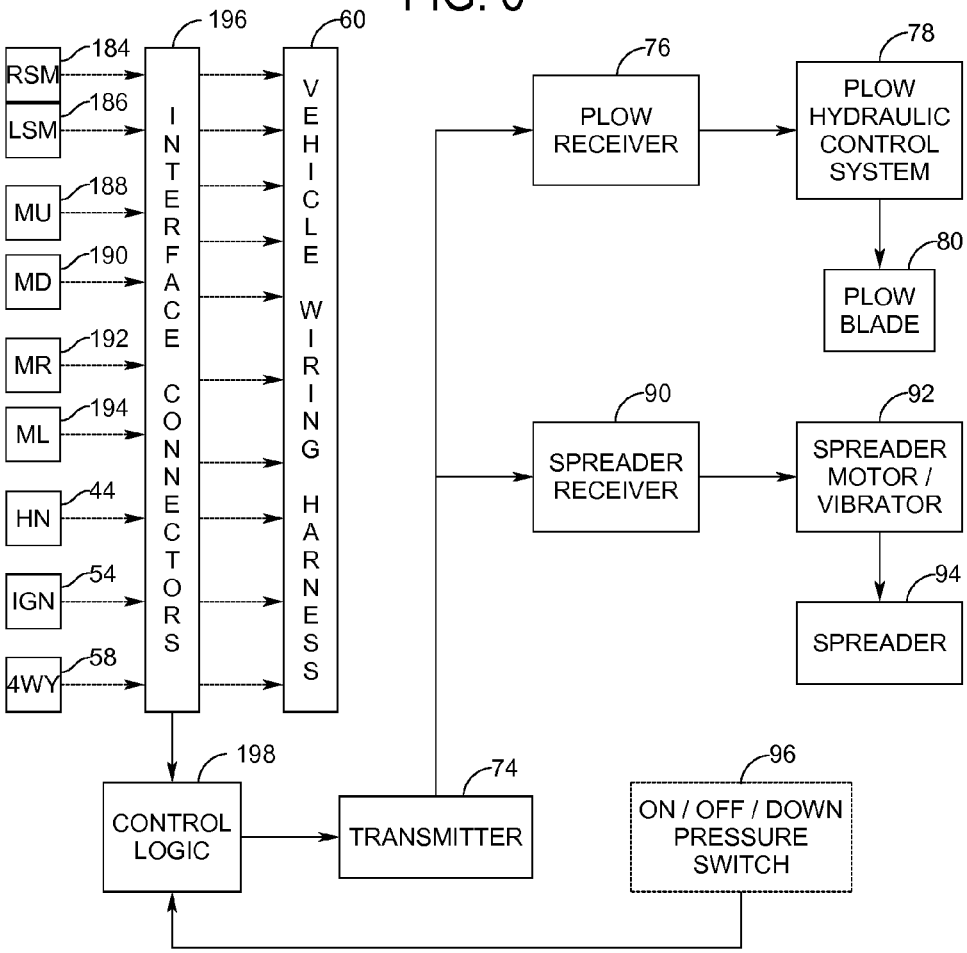
FIG. 6 is a functional schematic diagram of an alternate embodiment snow plow blade actuation system of the present invention similar to that of FIG. 2, but showing as it interfaces between the controls shown in FIG. 5 and, optionally, the hydraulic control system of a snow plow and the motor of a spreader.

An exemplary embodiment of the alternate embodiment snow plow blade actuation system of the present invention using the side mirror selector switch 180 and the side mirror directional control switch 182 instead of the turn signal/high beam control stalk 30 is illustrated in FIG. 6. Prior to the installation of the alternate embodiment snow plow blade actuation system of the present invention, the various signal outputs (the right side mirror output 184, the left side mirror output 186, the mirror up output 188, the mirror down output 190, the mirror right output 192, the mirror left output 194, the honk horn signal output 44, the headlight signal output 48, the marker light signal output 50, the ignition switch signal output 54, and the 4-way flasher signal output 58) may be provided to the vehicle wiring harness 60 that is part of the vehicle. The snow plow blade actuation system of the present invention inserts interface connectors 196 between some or all of these signal outputs and the vehicle wiring harness 60. These interface connectors 196 provide both the signal outputs as well as connections to the vehicle wiring harness 60 to a control logic element 198.

The control logic element 198 operates in two alternate modes—a first or vehicle mode, in which it connects the various signal outputs from the side mirror selector switch 180 and the side mirror directional control switch 182 (the right side mirror output 184, the left side mirror output 186, the mirror up output 188, the mirror down output 190, the mirror right output 192, the mirror left output 194) to the vehicle wiring harness 60. In this operating mode, the various signal outputs operate the vehicle in the manner they were originally intended to (the side mirror selector switch 180 causes the side mirror directional control switch 182 to operate the power mirror on either the right side or the left side of the vehicle, and the side mirror directional control switch 182 causes the power mirror being operated by the side mirror directional control switch 182 to move upwardly, downwardly, right, or left).

The control logic element 198 has a second or plow mode, in which the various signal outputs from the side mirror selector switch 180 and the side mirror directional control switch 182 do not operate the power side mirrors of the vehicle in the manner there were originally intended to, but instead are used to operate the snow plow blade. In this operating mode, the various signal outputs from the side mirror selector switch 180 and the side mirror directional control switch 182 do not operate the turn signals and high beams as they did in the first or vehicle mode.

Instead, for example, with the side mirror selector switch 180 in position to actuate the right side mirror output 184, the side mirror directional control switch 182 may be used to raise, lower, angle right, and angle left the snow plow blade 80. It may also be used to apply the downwardly-oriented pressure applied to the plow blade 80 by holding the DOWN portion of the side mirror directional control switch 182 after the snow plow blade 80 is fully lowered, or remove the downwardly-oriented pressure applied to the plow blade 80 by holding the UP portion of the side mirror directional control switch 182 after the snow plow blade 80 is fully raised.

In this case, with the side mirror selector switch 180 in position to actuate the left side mirror output 186, the side mirror directional control switch 182 may be used to operate the spreader 94. For example, by pressing the UP portion of the side mirror directional control switch 182 the spreader 94 may be turned on, and by continuing to press the UP portion of the side mirror directional control switch 182 the speed of the spreader may be increased. Likewise, by pressing the DOWN portion of the side mirror directional control switch 182 the speed of the spreader may be decreased, and by continuing to press the DOWN portion of the side mirror directional control switch 182 the spreader 94 may be turned off.

By pressing the RIGHT portion of the side mirror directional control switch 182 the vibrator in the spreader 94 could be turned on, and by pressing the LEFT portion of the side mirror directional control switch 182 the vibrator in the spreader 94 could be turned off. Other implementations using the side mirror selector switch 180 and the side mirror directional control switch 182 are also possible, as will be appreciated by those skilled in the art. The rest of the elements of FIG. 6 are identical in function and operation to those elements discussed above with reference to FIG. 2.

Although the foregoing description of the snow plow blade actuation system of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A snow plow control system for use with a vehicle having a snow plow mounted to the vehicle, the vehicle having a wiring harness that is electrically connected to a plurality of electrical switches in the vehicle including electrical switches of a turn signal/high beam control stalk located in the vehicle that are used to operate turn signals and headlights located on the vehicle, the snow plow comprising a plow mounting carriage mounted to the front of the vehicle, a snow plow blade mounted at the front of the plow mounting carriage, and an adjusting mechanism for raising, lowering, and pivoting the snow plow blade with respect to the vehicle, said snow plow control system comprising:

an electrical interface for installation intermediate the wiring harness of the vehicle and the plurality of electrical switches in the vehicle including the electrical switches of the turn signal/high beam control stalk located in the vehicle that are used to operate the turn signals and headlights located on the vehicle; and a control system electrically connected to said electrical interface, said control system being selectively, alternately operable in either a first mode or a second mode;

wherein when said control system is in said first mode the turn signal/high beam control stalk is operable to control the turn signals and the headlights located on the vehicle; and wherein when said control system is in said second mode the turn signal/high beam control stalk is operable to control the adjusting mechanism for raising, lowering, and pivoting the snow plow blade with respect to the vehicle.

2. A snow plow control system as defined in claim 1, wherein the vehicle includes a plurality of electrical connections from the turn signal/high beam control stalk of the vehicle to the wiring harness of the vehicle, and wherein said electrical interface comprises:

a plurality of interface connectors which are installed intermediate the plurality of electrical connections from the turn signal/high beam control stalk of the vehicle and the wiring harness of the vehicle.

3. A snow plow control system as defined in claim 1, additionally comprising:

an on/off switch for installation in the vehicle, said on/off switch being electrically connected to said control system and being selectively operable to cause said control system to switch from said first mode to said second mode and from said second mode to said first mode.

4. A snow plow control system as defined in claim 1, wherein said control system is configured to switch from said first mode to said second mode upon detection by said control system of a first predetermined sequence of actuation of one or more of the electrical switches in the vehicle, and wherein said control system is configured to switch from said second mode to said first mode upon detection by said control system of a second predetermined sequence of actuation of one or more of the electrical switches in the vehicle.

5. A snow plow control system as defined in claim 4, the electrical switches in the vehicle including an ignition switch, the vehicle having marker lights, headlights, and 4-way flashers, wherein said control system is arranged and configured such that said first predetermined sequence comprises:

turning on the ignition switch of the vehicle, then turning on the marker lights of the vehicle (but not the headlights of the vehicle), then turning on the 4-way flashers of the vehicle, then turning off the 4-way flashers, and then turning on the headlights.

6. A snow plow control system as defined in claim 4, the electrical switches in the vehicle including a horn switch, the vehicle having marker lights and a horn, wherein said control system is arranged and configured such that said second predetermined sequence comprises:

turning off the marker lights or honking the horn of the vehicle.

7. A snow plow control system as defined in claim 1, wherein the snow plow is selectively operable in a mode wherein a downwardly-oriented pressure is applied to the snow plow blade, said snow plow control system additionally comprising:

an on/off/down pressure switch for installation in the vehicle, said on/off/down pressure switch being electrically connected to said control system and being selectively operable to cause said control system to switch from said first mode to said second mode and from said second mode to said first mode;

wherein said on/off/down pressure switch is also selectively operable to cause downwardly-oriented pressure to be applied to the snow plow blade or to prevent downwardly-oriented pressure from being applied to the snow plow blade.

8. A snow plow control system as defined in claim 1, wherein the snow plow is selectively operable in a mode wherein a downwardly-oriented pressure is applied to the snow plow blade; and wherein when said control system is in said second mode the turn signal/high beam control stalk is also operable to cause downwardly-oriented pressure to be applied to the snow plow blade or to remove downwardly-oriented pressure from being applied to the snow plow blade.

9. A snow plow control system as defined in claim 8, wherein said control system is arranged and configured such that:

the turn signal/high beam control stalk is only operable to cause downwardly-oriented pressure to be applied to the snow plow blade when the snow plow blade is fully lowered; and the turn signal/high beam control stalk operates to cause downwardly-oriented pressure to be removed from the snow plow blade prior to being operable to cause the snow plow blade to be lifted from a fully lowered position.

10. A snow plow control system as defined in claim 1, wherein said control system is arranged and configured such that:

the snow plow blade may be caused to move to the left by turning the turn signal/high beam control stalk to the left; and the snow plow blade may be caused to move to the right by turning the turn signal/high beam control stalk to the right.

11. A snow plow control system as defined in claim 10, wherein said control system is arranged and configured such that:

the snow plow blade may be caused to jog to the left by momentarily turning the turn signal/high beam control stalk to the left and then returning the turn signal/high beam control stalk to a neutral position;

the snow plow blade may be caused to move all the way to the left by turning the turn signal/high beam control stalk to the left until the snow plow blade has moved all the way to the left and then returning the turn signal/high beam control stalk to a neutral position;

the snow plow blade may be caused to jog to the right by momentarily turning the turn signal/high beam control stalk to the right and then returning the turn signal/high beam control stalk to a neutral position; and the snow plow blade may be caused to move all the way to the right by turning the turn signal/high beam control stalk to the right until the snow plow blade has moved all the way to the right and then returning the turn signal/high beam control stalk to a neutral position.

12. A snow plow control system as defined in claim 1, wherein said control system is arranged and configured such that:

the plow blade may be caused to be lowered by pulling the turn signal/high beam control stalk toward the driver and simultaneously turning the turn signal/high beam control stalk to the left; and the snow plow blade may be caused to be raised by pulling the turn signal/high beam control stalk toward the driver and simultaneously turning the turn signal/high beam control stalk to the right.

13. A snow plow control system as defined in claim 12, wherein said control system is arranged and configured such that:

the snow plow blade may be caused to jog downwardly by momentarily pulling the turn signal/high beam control stalk toward the driver and simultaneously turning the turn signal/high beam control stalk to the left and then returning the turn signal/high beam control stalk to a neutral position;

the snow plow blade may be caused to move all the way down by pulling the turn signal/high beam control stalk toward the driver and simultaneously turning the turn signal/high beam control stalk to the left until the snow plow blade has moved all the way down and then returning the turn signal/high beam control stalk to a neutral position;

the snow plow blade may be caused to jog upwardly by momentarily pulling the turn signal/high beam control stalk toward the driver and simultaneously turning the turn signal/high beam control stalk to the right and then returning the turn signal/high beam control stalk to a neutral position; and the snow plow blade may be caused to move all the way up by pulling the turn signal/high beam control stalk toward the driver and simultaneously turning the turn signal/high beam control stalk to the right until the snow plow blade has moved all the way up and then returning the turn signal/high beam control stalk to a neutral position.

14. A snow plow control system as defined in claim 1, wherein the vehicle has a spreader mounted on the vehicle; and wherein when said control system is in said second mode the turn signal/high beam control stalk is operable to control the operation of the spreader.

15. A snow plow control system as defined in claim 14, wherein said control system is arranged and configured such that:

the spreader may be turned on by pushing the turn signal/high beam control stalk forward and simultaneously turning the turn signal/high beam control stalk to the left and then returning the turn signal/high beam control stalk to a neutral position; and the spreader may be turned off by pushing the turn signal/high beam control stalk forward and simultaneously turning the turn signal/high beam control stalk to the right and then returning the turn signal/high beam control stalk to a neutral position.

16. A snow plow control system as defined in claim 15, wherein said control system is arranged and configured such that:

the spreader may have its speed increased by pushing the turn signal/high beam control stalk forward and simultaneously turning the turn signal/high beam control stalk to the left until the speed of the spreader is increased sufficiently and then returning the turn signal/high beam control stalk to a neutral position; and the spreader may have its speed decreased by pushing the turn signal/high beam control stalk forward and simultaneously turning the turn signal/high beam control stalk to the right until the speed of the spreader is decreased sufficiently and then returning the turn signal/high beam control stalk to a neutral position.

17. A snow plow control system as defined in claim 14, wherein the spreader includes a vibrator, and wherein said control system is arranged and configured such that:

the vibrator may be turned on or off by pulling the turn signal/high beam control stalk backward and holding it there for a predetermined time.

18. A snow plow control system for use with a vehicle having a snow plow mounted to the vehicle, the vehicle having a wiring harness that is electrically connected to a plurality of electrical switches in the vehicle including electrical switches of a turn signal/high beam control stalk located in the vehicle that are used to operate turn signals and headlights located on the vehicle, the snow plow comprising a plow mounting carriage mounted to the front of the vehicle, a snow plow blade mounted at the front of the plow mounting carriage, and an adjusting mechanism for raising, lowering, and pivoting the snow plow blade with respect to the vehicle, wherein the snow plow is selectively operable in a mode wherein a downwardly-oriented pressure is applied to the snow plow blade, said snow plow control system comprising:

an electrical interface for installation intermediate the wiring harness of the vehicle and the plurality of electrical switches in the vehicle including the electrical switches of the turn signal/high beam control stalk located in the vehicle that are used to operate the turn signals and headlights located on the vehicle; and a control system electrically connected to said electrical interface, said control system having a first mode and a second mode and being switchable from said first mode to said second mode by detection of a first predetermined sequence of actuation of one or more of the electrical switches in the vehicle, and said control system also being switchable from said second mode to said first mode by detection of a second predetermined sequence of actuation of one or more of the electrical switches in the vehicle;

wherein when said control system is in said first mode the turn signal/high beam control stalk is operable to control the turn signals and the headlights located on the vehicle; and wherein when said control system is in said second mode the turn signal/high beam control stalk is operable to control the adjusting mechanism for raising, lowering, and pivoting the snow plow blade with respect to the vehicle; and wherein when said control system is in said second mode the turn signal/high beam control stalk is also operable to cause downwardly-oriented pressure to be applied to the snow plow blade or to remove downwardly-oriented pressure from being applied to the snow plow blade.

19. A snow plow control system for use with a vehicle having a snow plow mounted to the vehicle, the vehicle having a wiring harness that is electrically connected to a plurality of electrical switches in the vehicle including electrical switches of a turn signal/high beam control stalk located in the vehicle that are used to operate turn signals and headlights located on the vehicle, the snow plow comprising a plow mounting carriage mounted to the front of the vehicle, a snow plow blade mounted at the front of the plow mounting carriage, and an adjusting mechanism for raising, lowering, and pivoting the snow plow blade with respect to the vehicle, said snow plow control system comprising:

an interface for electrical connection to the wiring harness of the vehicle including the electrical switches of the turn signal/high beam control stalk located in the vehicle that are used to operate the turn signals and headlights located on the vehicle; and a control system electrically connected to said interface and being selectively, alternately operable in either a first mode or a second mode;

wherein when said control system is in said first mode the turn signal/high beam control stalk is operable to control the turn signals and the headlights located on the vehicle; and wherein when said control system is in said second mode the turn signal/high beam control stalk is operable to control the adjusting mechanism for raising, lowering, and pivoting the snow plow blade with respect to the vehicle.

20. A method for controlling the position of a snow plow blade mounted on a plow mounting carriage that is in turn mounted to the front of a vehicle, the vehicle having a wiring harness that is electrically connected to a plurality of electrical switches in the vehicle including electrical switches of a turn signal/high beam control stalk located in the vehicle that are used to operate turn signals and headlights located on the vehicle, the snow plow blade being raised, lowered, and pivoted by an adjusting mechanism, said method comprising:

providing an interface installed intermediate the wiring harness of the vehicle and the plurality of electrical switches in the vehicle including the electrical switches of the turn signal/high beam control stalk located in the vehicle that are used to operate the turn signals and headlights located on the vehicle;

electrically connecting a control system to said interface, said control system being selectively, alternately operable in either a first mode or a second mode;

using the turn signal/high beam control stalk to operate the turn signals and the headlights located on the vehicle when said control system is in said first mode; and using the turn signal/high beam control stalk to operate the adjusting mechanism for raising, lowering, and pivoting the snow plow blade with respect to the vehicle when said control system is in said second mode.

* * * * *